US009057234B2

(12) United States Patent
Yajure

(10) Patent No.: US 9,057,234 B2
(45) Date of Patent: Jun. 16, 2015

(54) CIRCUMFERENTIAL CAMS FOR MECHANICAL CASE RUNNING TOOL

(75) Inventor: Edgar Fernando Yajure, Calgary (CA)

(73) Assignee: Tesco Corporation, Houston, TX (US)

( * ) Notice: Subject to any disclaimer, the term of this patent is extended or adjusted under 35 U.S.C. 154(b) by 387 days.

(21) Appl. No.: 13/333,833

(22) Filed: Dec. 21, 2011

(65) Prior Publication Data

US 2013/0161965 A1 Jun. 27, 2013

(51) Int. Cl.

| | |
|---|---|
| ***E21B 23/00*** | (2006.01) |
| ***E21B 19/00*** | (2006.01) |
| ***B66C 1/56*** | (2006.01) |
| ***E21B 23/01*** | (2006.01) |
| ***E21B 43/10*** | (2006.01) |

(52) U.S. Cl.

CPC ..... *E21B 23/01* (2013.01); *E21B 43/10* (2013.01)

(58) Field of Classification Search

USPC ..... 294/68.25, 86.24, 86.26, 86.12, 86.19, 294/86.25, 93, 94, 96; 166/380, 381, 77.51, 166/77.52; 242/571.1

See application file for complete search history.

(56) References Cited

U.S. PATENT DOCUMENTS

| | | | | | |
|---|---|---|---|---|---|
| 769,097 | A | * | 8/1904 | Mapes | 294/86.19 |
| 1,383,345 | A | * | 7/1921 | Sheehan | 294/86.19 |
| 1,777,592 | A | * | 10/1930 | Thomas | 294/86.17 |
| 1,815,462 | A | * | 7/1931 | Denney | 294/86.15 |
| 1,825,025 | A | | 9/1931 | Thomas et al. | |
| 1,825,026 | A | | 9/1931 | Thomas | |
| 2,542,679 | A | * | 2/1951 | Kemnitz | 294/86.24 |
| 3,108,637 | A | * | 10/1963 | Lee et al. | 294/86.22 |
| 6,062,309 | A | | 5/2000 | Gosse | |
| 7,191,840 | B2 | | 3/2007 | Pietras et al. | |

FOREIGN PATENT DOCUMENTS

GB 2155577 * 9/1985

OTHER PUBLICATIONS

International Search Report and Written Opinion for International Application No. PCT/US2012/067080 mailed Jan. 7, 2014.

* cited by examiner

*Primary Examiner* — Paul T Chin
(74) *Attorney, Agent, or Firm* — Fletcher Yoder, P.C.

(57) ABSTRACT

A casing running tool is provided having both axial and circumferentially tapered elements. In certain embodiments, the casing running tool comprises cam structures that are circumferentially tapered so as to allow an applied torque to engage and disengage the casing running tool with a casing or liner. In embodiments, the circumferential taper of the cam structures allows a mandrel or rollers disposed between the mandrel and cam structures to apply radial force to corresponding shoe structures which in turn engage or disengage the casing or liner. The cam structures may also exhibit an axial taper to allow for a self-energized fail-sage operation of the casing running tool.

19 Claims, 6 Drawing Sheets

CIRCUMFERENTIAL CAMS FOR MECHANICAL CASE RUNNING TOOL

FIELD OF DISCLOSURE

The present disclosure relates generally to the field of well drilling operations. More specifically, embodiments of the present disclosure relate to casing running tools having a wedge-shaped element engaged between the central mandrel of the tool and the inner bore of the casing.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

Liner may also be employed in some drilling operations. Liner may be defined as a string of pipe or tubular that is used to case open hole below existing casing. Casing is generally considered to extend all the way back to a wellhead assembly at the surface. In contrast, a liner merely extends a certain distance (e.g., 30 meters) into the previously installed casing or parent casing string. However, a tieback string of casing may be installed that extends from the wellhead downward into engagement with previously installed liner. The liner is typically secured to the parent casing string by a liner hanger that is coupled to the liner and engages with the interior of the upper casing or liner. The liner hanger may include a slip device (e.g., a device with teeth or other gripping features) that engages the interior of the upper casing string to hold the liner in place. It should be noted that, in some operations, a liner may extend from a previously installed liner or parent liner. Again, the distinction between casing and liner is that casing generally extends all the way to the wellhead and liner only extends to a parent casing or liner. Accordingly, the terms "casing" and "liner" may be used interchangeably in the present disclosure. Indeed, liner is essentially made up of similar components (e.g., strings of tubular structures) as casing. Further, as with casing, a liner is typically cemented into the well.

Whether casing or liners are used for any particular well, the casing or liner strings are run into the wellbore using a running tool. In conventional approaches, a mechanically and/or hydraulically actuated casing running tool includes a wedge shaped element that is engaged between the central mandrel of the tool and the inner bore of the casing or liner by means of axial motion. These wedges may self-actuate further due to the weight of the casing string itself, providing a fail-safe mechanism when engaged due to the tool continuing to grip even in the event of power-loss to the engagement mechanism. Such an approach, however, creates issues related to providing sufficient engagement between the running tool and the liner or casing when there is limited weight suspended from the string which, as noted above, is self-energized due to the action of gravity. For example, in current approaches, a hydraulic system separate from the main drive system (i.e., the top drive) may be employed to engage and disengage the running tool and the casing or liner.

BRIEF DESCRIPTION

In accordance with one aspect of the invention, a running tool includes a cam portion comprising one or more cam structures tapered in an axial direction relative to a downhole configuration of the running tool. The one or more cam structures are also tapered in a circumferential direction such that the thickness of each cam structure increases in a circumferential plane of the running tool. The running tool also includes a shoe portion tapered in a complementary axial direction relative to the one or more cam structures. The taper of the shoe portion allows the shoe portion to rest on the one or more tapered cam structures in the absence of an externally applied torque.

In accordance with another aspect of the invention, a running tool includes a cam portion comprising one or more cam structures tapered in an axial direction relative to a downhole configuration of the running tool. The taper of the one or more cam structure in the axial direction is complementary to a tapered portion of a mandrel when the cam portion is disposed about the tapered portion of the mandrel. The one or more cam structures are also tapered in a circumferential direction such that the thickness of each cam structure increases in a circumferential plane of the running tool. The running tool also includes a shoe portion comprising one or more shoe structures that move in response to a radial motion of the one or more cam structures.

In accordance with another aspect of the invention, a running tool includes a cam portion comprising one or more cam structures tapered in a circumferential direction relative to a downhole configuration of the running tool. The thickness of each cam structure increases in a circumferential plane of the running tool. The running tool also includes a shoe portion comprising one or more shoe structures that move in response to a radial motion of the one or more cam structures. The running tool also includes a plurality of rollers configured to be disposed between the cam portion and a mandrel. The mandrel, when rotated in a first direction, causes rolling motion of the rollers with respect to the one or more cam structures such that the one or more cam structures push outward on all or part of the shoe portion.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

The present disclosure relates generally to methods and equipment for running casing or liner strings into a wellbore. More specifically, embodiments of the present disclosure are directed to providing a mechanism that decouples the engagement of a casing running tool due to the action of gravity. In one implementation, two sets of tapers are provided, one of increasing thickness in the circumferential direction and another of increasing thickness in the axial direction. In such an approach, the running tool is able to be engaged with the casing or liner by means of the torque provided by the top-drive, causing the engagement interface to ride up the circumferential cams. Disengagement may be accomplished by reversing the direction of rotation applied by the top-drive. Self-energization provided by the pull of gravity is employed for fail-safe operation and is facilitated using a set of axial ramps which may be integral to the circumferential ramps.

Figure 1:
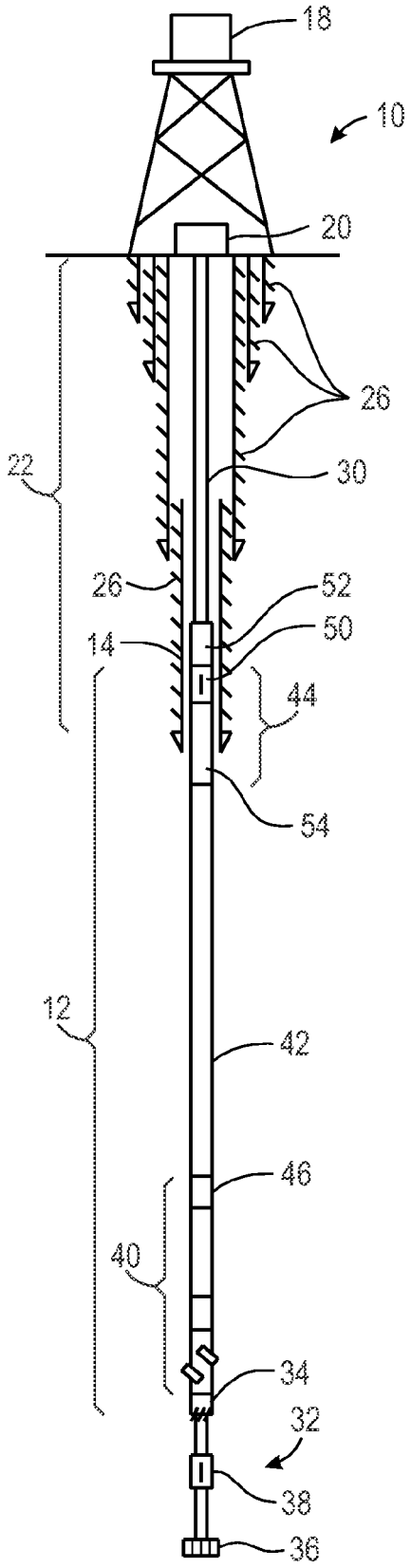
FIG. 1 is a schematic representation of a well being drilled in accordance with aspects of the present disclosure.

Turning to the figures, FIG. 1 is a schematic representation of a well 10 that is being drilled using a casing-while-drilling technique, wherein a liner string 12 is about to be hung within a previously installed liner 14 that was cemented into the well 10 in accordance with present techniques. In other embodiments, different drilling techniques may be employed. The well 10 includes a derrick 18, wellhead equipment 20, and several levels of casing 22 (e.g., conductor pipe, surface pipe, intermediate string, and so forth), which includes the previously installed liner 14, which may be casing in some embodiments. The casing 22 and the liner 14 have been cemented into the well 10 with cement 26. Further, as illustrated in FIG. 1, the liner string 12 is in the process of being hung from the previously installed liner 14, which may be referred to as the parent liner 14.

While other embodiments may utilize different drilling techniques, as indicated above, the well 10 is being drilled using a casing-while-drilling technique. Specifically, the liner string 12 is being run as part of the drilling process. In the illustrated embodiment, a drill pipe 30 is coupled with the liner string 12 and a drilling BHA 32. The drilling BHA 32 is also coupled with an upper portion of the liner string 12 and extends through the liner string 12 such that certain features of the drilling BHA 32 extend out of the bottom of the liner string 12. Indeed, an upper portion of the drilling BHA 32 is disposed within the inside diameter of the liner string 12, while a lower portion of the drilling BHA 32 extends out of a liner shoe 34 at the bottom of the liner string 12. Specifically, in the illustrated embodiment, a drill bit 36 and an under reamer 38 of the drilling BHA 32 extend out from the liner string 12. Thus, the drilling BHA 32 is positioned to initiate and guide the drilling process.

The liner string 12 includes a shoe track 40, a string of tubing 42, and a liner top assembly 44. The shoe track 40 defines the bottom of the liner string 12 and includes the liner shoe 34 to facilitate guiding the liner string 12 through the wellbore. In the illustrated embodiment, the shoe track 40 also includes an indicator landing sub 46 to facilitate proper engagement with the drilling BHA 32, and various other features, such as a pump down displacement plug (PDDP). The string of tubing 42 is essentially the main body of the liner string 12 that connects the shoe track 40 with the liner top assembly 44. The liner top assembly 44, which defines the top of the liner string 12, includes a liner hanger 50 that is capable of being activated and/or deactivated by a liner hanger control tool 52. The liner top assembly 44 may also include a liner drill lock section 54, which includes a liner drill lock that facilitates engagement/disengagement of the drill string 30 from the liner string 12. The liner drill lock may be actuated by external or internal components affixed to or part of a body of the liner hanger 50.

Once a desired depth is reached, the liner string 12 may be hung or set down to facilitate detachment of the drilling BHA 32. As illustrated in FIG. 1, the liner string 12 may be hung from the parent liner 14, and the drilling BHA 32 may be detached from the liner string 12 and pulled out of the well 10 with the drill string 30 and an inner string (not shown). In order to hang the liner string 12 from the parent liner 14, the hanger 50 may be activated with the liner hanger control tool 52. In some embodiments, the hanger 50 is not utilized and the liner string 12 is set on bottom.

Figure 2:
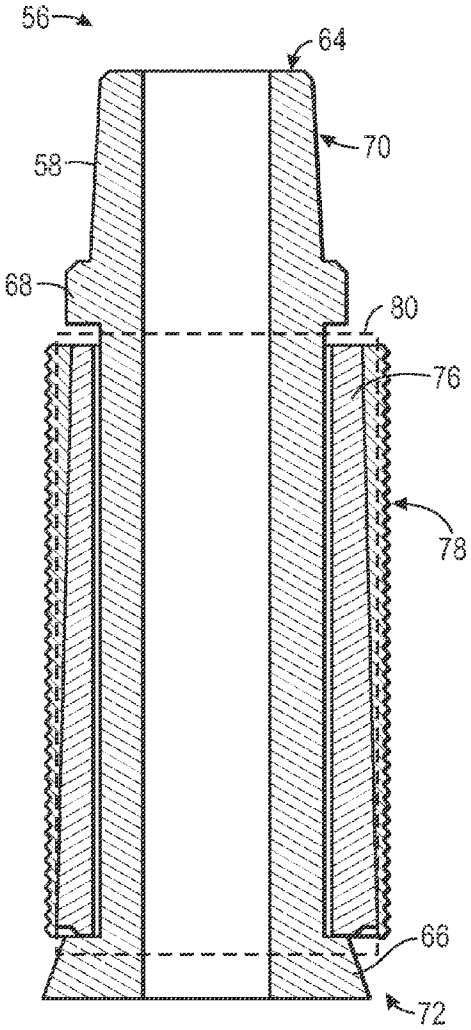
FIG. 2 depicts a partial cross-section of a side-view of a casing running tool in accordance with aspects of the present disclosure.

The casing and liner strings (e.g., the casing 22, the parent liner 14, and the liner string 12) are run into the well 10 using a running tool. Also described above, the terms "casing" and "liner" may be used interchangeably in the present disclosure. More specifically, while the embodiments described herein may generally refer to the running tools as "casing running tools," it will be understood that the casing running tools described herein may also be used as liner running tools. Turning to FIG. 2, a cut-away side view of a portion of a casing running tool 56 is depicted in accordance with aspects of the present disclosure. As will be appreciated, the casing running tool 56 may be used to run the casing and liner strings of FIG. 1 (e.g., the casing 22, the parent liner 14, and the liner string 12) into the well 10.

As illustrated in FIG. 2, the casing running tool 56 includes a central mandrel 58. In certain embodiments, the central mandrel 58 includes a generally cylindrical main body portion 64 that, as described in greater detail below, is configured to be inserted into casing or liners (e.g., the casing 22, the parent liner 14, and the liner string 12 of FIG. 1) to support the weight of the casing or liners while they are inserted into a well, such as the well 10 of FIG. 1. In the depicted example, the central mandrel 58 may also include one or more flanges, such as a first flange 66 and a second flange 68, as well as an upper insertion portion 70 near an upper (e.g., top) end of the central mandrel 58 and a lower insertion portion 72 near a lower (e.g., bottom) end of the central mandrel 58.

In the depicted embodiment, a cam 76 and a shoe 78 are depicted disposed between the first flange 66 and second flange 68 of the mandrel 58. In one embodiment, the cam 76 and/or the shoe 78 may be provided as part of a cage assembly 80 which secures one or both of these components with respect to the motion of the mandrel 58. In the depicted implementation, the cam 76 and the shoe 78 are provided as separate components that may move separately from one another in the down-hole axial direction. However, the cam 76 and the shoe 78 move generally together in the circumferential direction. In one implementation, the cage 80 may provide an initial resistance to rotation of the shoe 78, thereby preventing the shoe 78 from rotating freely with the mandrel 58. For example, in certain embodiments, the shoe 78 may be provided as a plurality of components secured (such as by one or more hinges or other securement mechanisms) to the cage 80. In one such embodiment, the shoe 78 may be secured to the cage 80 and may protrude to varying degrees through slots or other openings provided in the cage 80 depending on the rotation of the mandrel 58 and of the one or more tapered cams 76. In other embodiments, some other form of external flange bearing on the end of the casing (other than the noted cage assembly) may resist rotation of the cam 76 and shoe 78 relative to the rotation of the mandrel 58.

In one implementation, as depicted in FIG. 2, the cam 76 may be tapered in the axial direction such that the cam 76 increases in thickness in the down-hole axial direction, i.e., the cam 76 increases in thickness toward the lower insertion portion 72 of the mandrel 58. Conversely, the shoe 78 is tapered in a complementary manner such that the shoe 78 decreases in thickness in the down-hole axial direction, i.e., the shoe 78 decreases in thickness toward the lower insertion portion 72 of the mandrel 58. In an implementation where the cam 76 and shoe 78 can move independent of one another in the axial direction, a loss of power will result in gravity pulling an attached liner string downward, engaging the complementary tapered surfaces of the cam 76 and shoe 78 together and acting as a gravity-energized fail-safe mechanism.

Figure 3:
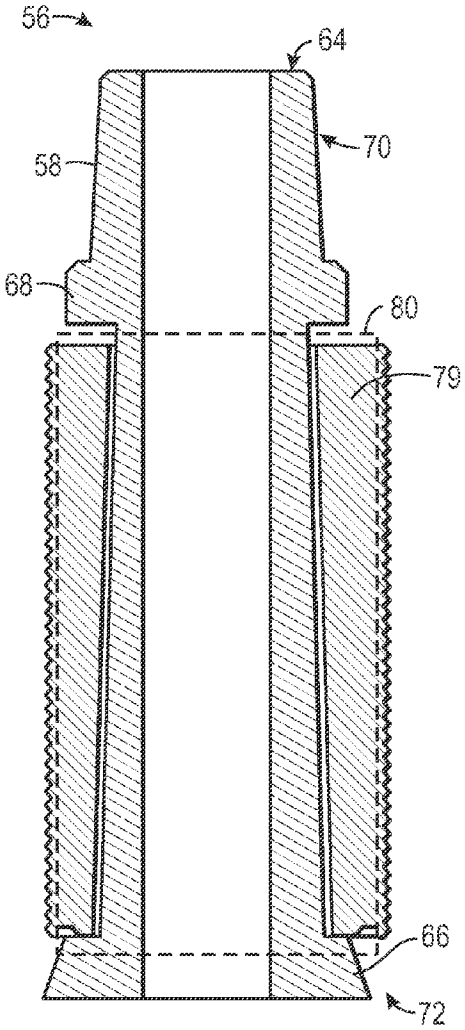
FIG. 3 depicts a partial cross-section of a side-view of a casing running tool in accordance with further aspects of the present disclosure.

As will be appreciated, in an additional implementation, the mandrel 58 itself may be tapered in the relevant region of the casing running tool 56. In such an implementation, as depicted in FIG. 3, the cam 76 and shoe 78 may be integrated as a single piece 79 and/or may otherwise move together, i.e., as a single piece, independently of the mandrel 58 in the axial direction and the cam 76 may be tapered in a complementary fashion to the taper of the mandrel 58 (i.e., the mandrel may be exhibit increasing thickness in the down-hole axial direction while the cam 76 may exhibit decreasing thickness in the down-hole axial direction). In such an implementation, the result would be the same in the event of a loss of power in that the gravity pull on an attached liner string would cause the engagement of the complementary tapered surfaces to provide a fail-safe mechanism.

Figure 4:
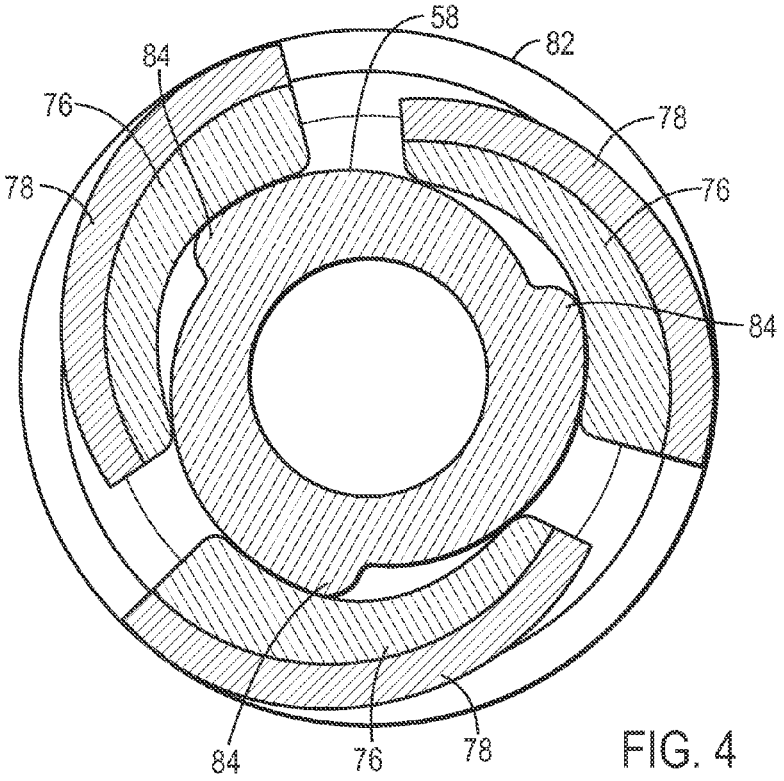
FIG. 4 depicts a partial cross-section in an axial direction of a casing running tool in accordance with aspects of the present disclosure.

Turning to FIG. 4, a cross-sectional slice of a portion of a casing running tool 56 is provided. As noted above, the casing running tool 56 exhibits a complementary axial taper between the cam 76 and shoe 78 (or in some embodiments, between the mandrel 58 and cam 76). As depicted in FIG. 4, the cam 76 may also be tapered in a circumferential direction extending outward from the main axis of the mandrel 58. That is, in the depicted embodiment, the cam 76 is tapered such that the cam 76 increases in thickness proceeding in a first direction of rotation of the mandrel 58 (e.g., a clockwise direction in the depicted embodiment). In such an embodiment, as will be appreciated, the cam 76 effectively exhibits both an axial and a circumferential taper, where the axial taper provides self-energization in the event of hung weight and the circumferential taper, as discussed below, allows engagement and disengagement of the casing running tool 56 with a tubular component, such as a liner or casing.

With respect to the engagement process, in one embodiment rotation of the mandrel 58 causes contacting surfaces 84 of the mandrel 58 (here depicted as circumferentially protruding regions of the mandrel 58) to push against the thicker region of the cam 76, causing the cam 76 and contacted shoe 78 to push outward as the mandrel 58 rotates. In such an embodiment, the shoe 78 is pushed outward by this action and protrudes through one or more openings of the associated cage assembly 80 to contact an inner surface 82 of a casing or liner without any axial motion. In this manner, the surrounding casing or liner may be contacted with and held by the shoe 78 when the mandrel 58 is rotated. Conversely, rotation of the mandrel 58 in the opposite direction (e.g., a counter-clockwise direction in the depicted embodiment), causes the contacting surfaces 84 of the mandrel 58 to move away from the thicker region of the cam 76, causing the cam 76 and contacted shoe 78 to move inward and to release or disengage the surrounding casing or lining as the mandrel 58 rotates.

Figure 5:
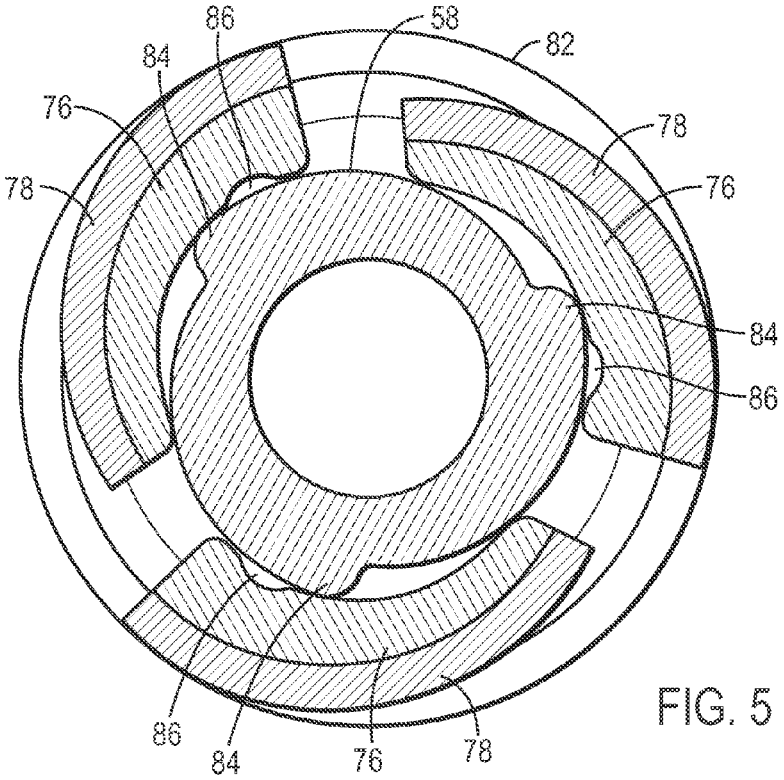
FIG. 5 depicts a partial cross-section in an axial direction of a casing running tool in accordance with further aspects of the present disclosure.

Turning to FIG. 5, in one embodiment, the cam 76 may also be provided with a notch or catch 86 that acts as an anti-rotation or slip prevention mechanism such that power loss or a slight backward rotation of the mandrel 58 does not cause accidental or incidental disengagement of the shoe 78 and surrounding casing or liner. That is, disengagement of the liner or casing from the casing running tool 56 only occurs upon application of at least a torque equal to or greater than a specified or designed release torque that is sufficient to overcome the resistance provided by the catch 86. In this manner, the catch 86, when present, prevents or limits incidental backwards rotation and consequent release of the surface 82 if the casing or liner for torques less than a specified or designed release torque. In other embodiments, however, such as the embodiment, depicted in FIG. 4, the friction between mandrel 58 (i.e., contacting surfaces 84) and the cam 76 may be sufficient to maintain engagement between the shoe 78 and surrounding casing or liner for torques less than the specified or designed release torque.

Figure 6:
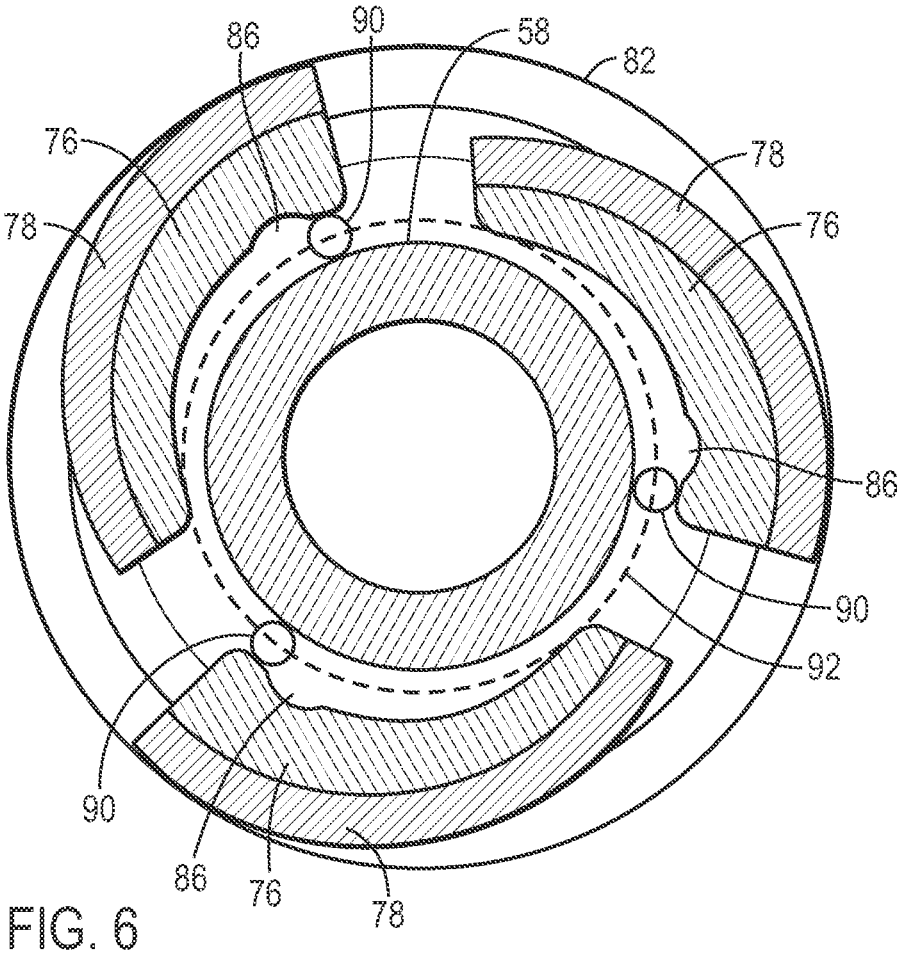
FIG. 6 depicts a partial cross-section in an axial direction of a casing running tool in accordance with additional aspects of the present disclosure.

Turning to FIG. 6, an embodiment including a plurality of rollers 90 (e.g., bearings or other rolling elements) is provided in place of the protruding contact surfaces 84 of preceding embodiments. In the depicted example, the cam 76 is tapered in the manner previously described so as to increase in thickness its cross-section in the direction of primary rotation of the mandrel 58 (e.g., in the clockwise direction). In this implementation, the rotation of the mandrel 58 causes the rollers 90 to move in the direction of rotation, pushing the cam 76 and shoe 78 outward due to the circumferential taper of the cam 76. In this manner, rotation of the mandrel 58 causes engagement of the shoe 78 with the inner surface of a casing or liner positioned outside the casing running tool 56. As will be appreciated, in certain embodiments, the rollers 90 engage the cams 76 but do not carry significant load as the taper of the cams 76 bears on the mandrel shoulder, e.g., flange 66. Further, in certain embodiments, a second cage assembly 92 may be employed with respect to the rollers 90 to maintain alignment of the rollers 90 with respect to the mandrel 58 and the cam 76.

In the depicted embodiment, the cam 76 is provided with a notch or catch 86 that acts to limit or prevent incidental backward rotation and consequent release of the casing or liner for torques less than a specified or designed release torque. That is, the catch 86 acts as an anti-rotation or slip prevention mechanism such that power loss or a slight backward rotation of the mandrel 58 does not cause disengagement of the shoe 78 and surrounding casing or liner absent application of a specified or designed release torque sufficient to overcome the resistance provided by the catch 86.

Figure 7:
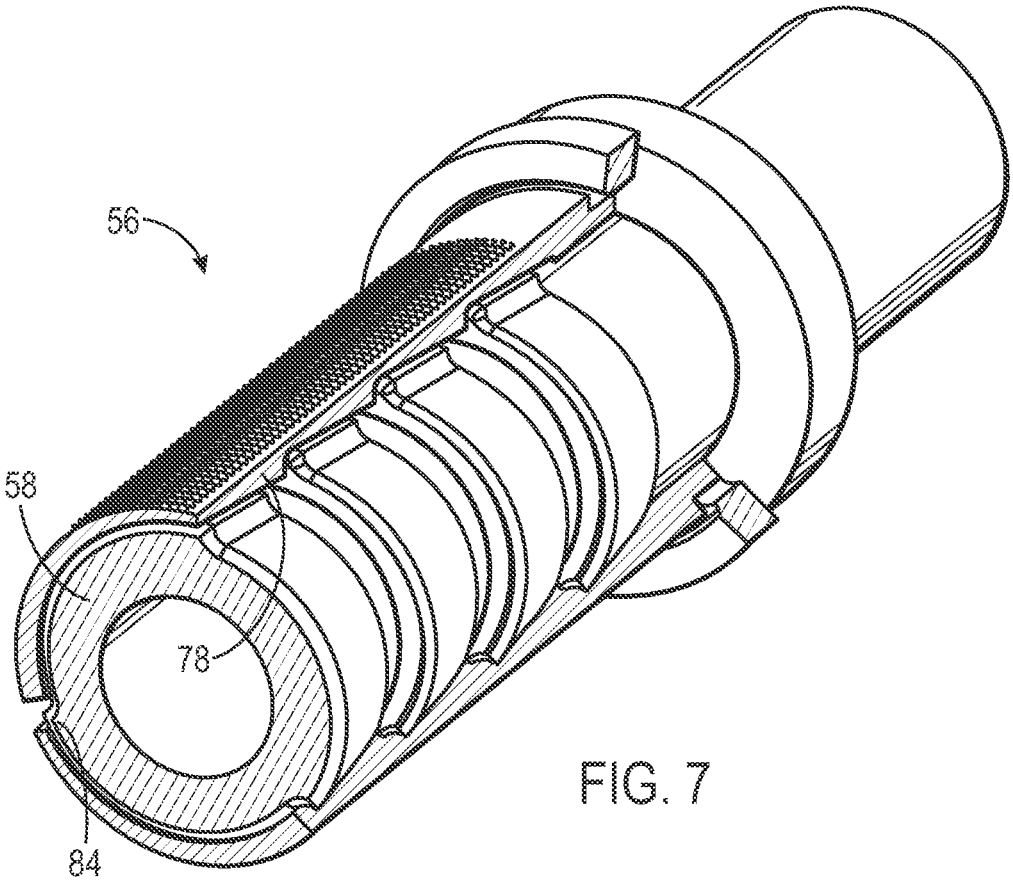
FIG. 7 depicts a cut-away of a perspective view of a casing running tool in accordance with additional aspects of the present disclosure.
Figure 8:
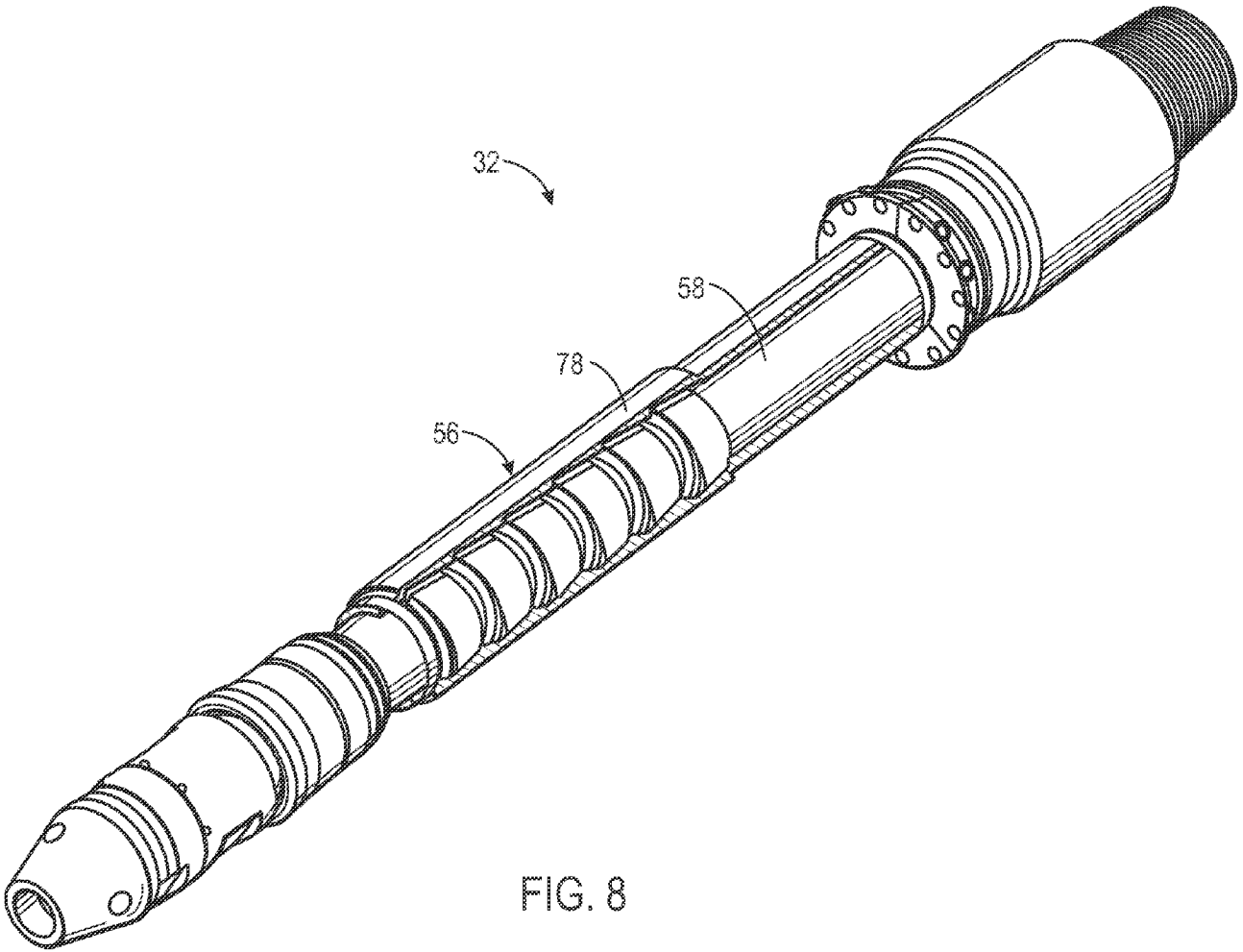
FIG. 8 depicts a cut-away of a perspective view of the casing running tool in the context of a hoisting assembly.

With the foregoing discussion in mind, FIG. 7 depict perspective, cut-away view of an embodiment of a casing running tool 56 as discussed herein. As depicted in this example, the respective axial and circumferential tapers are visible. Turning to FIG. 8, this casing running tool is further depicted in the overall context of an overall assembly, such as a bottom hole assembly (BHA) 32 for use in a down-hole environment.

With the foregoing discussion in mind, it should be appreciated that certain presently described embodiments allow engagement and disengagement of a casing running tool 56 via action of a top drive that rotates a mandrel 58. For example, once the casing running tool 56 has been inserted into the inner bore of the casing or liner, the top drive 56 may be operated to generate torque which, by one or more of the mechanisms discussed herein, cause the tapered cams 76 to move radially outwards, in turn causing the shoe 78 to engage the inner surface of the casing or liner. Conversely, reversal of the direction of rotation of the mandrel 58 may cause the tapered cams to retract radially inwards, in turn causing the shoe 78 to disengage from the inner surface of the casing or liner. In this manner, a circumferential or rotational motion of the mandrel 58 may cause engagement and disengagement of the casing running tool 56 and the inner bore of the casing or lining. Although no axial movement is necessary to cause this engagement, the axial tapers of the cam 76 and shoe 78 or of the mandrel 58 and cam 76 discussed herein provide self-energization for fail-safe operation.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A running tool, comprising:

a cam portion comprising one or more cam structures tapered in an axial direction relative to a downhole configuration of the running tool and tapered in a circumferential direction such that the thickness of each cam structure increases in a circumferential plane of the running tool;

a shoe portion tapered in a complementary axial direction relative to the one or more cam structures, wherein the taper of the shoe portion allows the shoe portion to rest on the one or more tapered cam structures in the absence of an externally applied torque;

a mandrel comprising a casing running tool portion about which the cam portion and the shoe portion are radially disposed, wherein the mandrel, when rotated in a first direction, engages the cam portion of the running tool and causes the one or more cam structures to push outward on all or part of the shoe portion; and a drive configured to cause rotation of the mandrel in at least the first direction.

2. The running tool of claim 1, wherein the shoe portion moves separate from the cam portion in the axial direction.

3. The running tool of claim 1, wherein the shoe portion moves substantially with the cam portion in a first direction of rotation.

4. The running tool of claim 1, comprising a cage assembly housing at least the shoe portion.

5. The running tool of claim 4, wherein the cage assembly provides an initial resistance to rotation of the shoe portion relative to the cam portion.

6. The running tool of claim 4, wherein the cage assembly is configured to rest on a shoulder of a mandrel absent rotation of the mandrel.

7. The running tool of claim 1, wherein each cam portion comprises a catch feature configured to inhibit incidental or accidental disengagement of the shoe portion from an inner surface of a casing or liner.

8. The running tool of claim 1, wherein the one or more cam structures, when rotated in a first direction, push radially outward the one or more shoe structures of the shoe portion.

9. A running tool, comprising:

a mandrel having a tapered portion;

a cam portion comprising one or more cam structures tapered in an axial direction relative to a downhole configuration of the running tool such that the taper of the one or more cam structures in the axial direction is complementary to the tapered portion of the mandrel when the cam portion is disposed about the tapered portion of the mandrel and wherein the one or more cam structures are tapered in a circumferential direction such that the thickness of each of the one or more cam structures increases in a circumferential plane of the running tool;

a shoe portion comprising one or more shoe structures that move in response to a radial motion of the one or more cam structures.

10. The running tool of claim 9, wherein the cam portion and the shoe portion are formed as a single piece.

11. The running tool of claim 9, comprising a cage assembly housing at least the shoe portion.

12. The running tool of claim 11, wherein the cage assembly provides an initial resistance to rotation of the shoe portion.

13. The running tool of claim 9, wherein each cam portion comprise a catch feature configured to inhibit incidental or accidental disengagement of the shoe portion from an inner surface of a casing or liner.

14. The running tool of claim 9, wherein the one or more cam structures, when rotated in a first direction, push radially outward the one or more shoe structures of the shoe portion.

15. A running tool comprising: a cam portion comprising one or more cam structures tapered in a circumferential direction relative to a downhole configuration of the running tool such that the thickness of each cam structure increases in a circumferential plane of the running tool;

a shoe portion comprising one or more shoe structures that move in response to a radial motion of the one or more cam structures; and a mandrel, wherein the mandrel, when rotated in a first direction, causes the one or more cam structures to push outward on all or part of the shoe portion.

16. The running tool of claim 15, comprising:

a plurality of rollers configured to be disposed between the cam portion and the mandrel such that, when the mandrel is rotated in the first direction, a rolling motion of the rollers with respect to the one or more cam structures cause the one or more cam structures to push outward on all or part of the shoe portion; and a roller cage assembly configured to maintain alignment of the plurality of rollers with respect to the cam portion.

17. The running tool of claim 15, wherein the one or more cam structures are tapered in an axial direction relative to the downhole configuration of the running tool and wherein the shoe portion is tapered in a complementary axial direction relative to the one or more cam structures.

18. The running tool of claim 15, comprising a cage assembly housing at least the shoe portion.

19. The running tool of claim 15, wherein the cage assembly provides an initial resistance to rotation of the shoe portion.

* * * * *